US010115258B1

(12) United States Patent
Lo

(10) Patent No.: US 10,115,258 B1
(45) Date of Patent: Oct. 30, 2018

(54) LOTTERY BALL MACHINE

(71) Applicant: Bingotimes Digital Technology Co., Ltd., Taichung (TW)

(72) Inventor: Chih-Tsung Lo, Taichung (TW)

(73) Assignee: Bingotimes Digital Technology Co., Ltd., Taichung (TW)

( * ) Notice: Subject to any disclaimer, the term of this patent is extended or adjusted under 35 U.S.C. 154(b) by 0 days.

(21) Appl. No.: 15/838,315

(22) Filed: Dec. 11, 2017

(51) Int. Cl.
*G07C 15/00* (2006.01)
*A63F 7/04* (2006.01)
*A63F 9/00* (2006.01)

(52) U.S. Cl.
CPC ..... *G07C 15/001* (2013.01); *A63F 7/048* (2013.01); *A63F 9/0079* (2013.01); *A63F 2009/0087* (2013.01)

(58) Field of Classification Search
CPC ..... G07C 15/00
USPC ..... 273/144 A
See application file for complete search history.

(56) References Cited

U.S. PATENT DOCUMENTS 4,813,676 A * 3/1989 Weatherspoon ..... A63F 7/048 273/144 A
5,121,920 A * 6/1992 Laezzo ..... G07C 15/001 273/144 A
5,419,557 A * 5/1995 Kirkland ..... A63F 7/048 273/144 A
7,699,316 B2 * 4/2010 Seelig ..... G07F 17/32 273/138.2
7,727,065 B2 * 6/2010 Seelig ..... G07F 17/3244 273/138.2
9,937,411 B2 * 4/2018 Okuaki ..... A63F 3/061

* cited by examiner

*Primary Examiner* — John E Simms, Jr.
*Assistant Examiner* — Dolores Collins
(74) *Attorney, Agent, or Firm* — Raymond Y. Chan; David and Raymond Patent Firm

(57) ABSTRACT

A lottery ball machine includes a box body, having tubes at a top thereof; a ball guide seat, having upper through holes and ball return holes at a top thereof and ball passages therein, upper ends of the ball passages being connected to the upper through holes, lower ends of the ball passages being communicated with the tubes; a ball control seat disposed above the ball guide seat, including an upper seat plate assembly having ball outlets, a lower seat plate having limit holes, receiving tubes connected to the limit holes, and displacement plates disposed at the bottom of the lower seat plate; ball tracks, upper ends of the ball tracks being disposed under the ball return holes, lower ends of the ball tracks corresponding to the box body, a gate assembly being provided between each ball track and the box body; and blowers, located under the box body.

9 Claims, 11 Drawing Sheets

LOTTERY BALL MACHINE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a lottery ball machine, and more particularly, to a lottery ball machine which can be used to draw balls for a variety of computer games at the same time. The balls can be recycled through different routes.

Description of Related Arts

As shown in FIG. 1, a conventional lottery ball machine comprises a circular cylinder 11 having a tube 12 inserted in the cylinder 11, a ball track 13, and a ball control mechanism 14. The ball track 13 has an upper opening 131 and a lower opening 132. The upper opening 131 is connected to the tube 12. The ball control mechanism 14 comprises a box body 141, a guide groove 15, and a recycling box 16. The box body 141 is rotatable. The box body 141 has a ball inlet 142 and a ball return hole 143 corresponding to the lower opening 132. With the above structure, a plurality of balls 1 can be placed in the cylinder 11. One of the balls 1 is drawn each time. The ball control mechanism 14 can block the ball 1 in front of the lower opening 132 of the ball track 13 for showing the drawn ball 1. Repeating this step, one or more balls 1 can be drawn for playing the game. When the game is over, the box body 141 of the ball control mechanism 14 is turned to align the ball inlet 142 with the lower opening 132, such that the ball 1 enters the cylinder 11 through the ball inlet 142 for the use of next round. If the box body 141 of the ball control mechanism 14 is turned to align the ball return hole 143 with the lower opening 132, all the balls 1 pass through the guide groove 15 to fall into the recycling box 16. The balls can be replaced for the use of different games. Although the aforesaid machine is able to draw a ball, it has some shortcomings. The lottery ball machine 10 can only play one game at the same time. The player cannot play other games simultaneously. After the game is over, the player leaves and looks for other game machines. For the players, it is inconvenient for use. If multiple game machines are used for playing games at the same time, it is difficult for the player to observe the drawn balls of all the games at a time. For the banker, the use of the lottery ball machine 10 is limited. It cannot achieve better economic efficiency and is not practical. Accordingly, the inventor of the present invention has devoted himself based on his many years of practical experiences to solve these problems.

SUMMARY OF THE PRESENT INVENTION

The primary object of the present invention is to solve the above problems and to provide a lottery ball machine which is more practical. The lottery ball machine has a plurality of accommodation spaces for accommodating balls of different games. Through the displacement and switch of receiving tubes and displacement plates of a ball control seat, the balls can be recycled from the route of drawing the balls or ball tracks for the different needs of computer games. The same machine may be used for different games at the same time to speed up the games, thereby increasing economic efficiency and reducing costs.

Through the above structure, the lottery ball machine can draw the respective balls from the accommodation spaces. Players can easily see the drawn balls of all the games, thereby enhancing the interest of the players and increasing the economic benefits of the gaming machine and reducing the equipment cost.

In order to achieve the aforesaid object, the lottery ball machine of the present invention comprises a box body, a ball guide seat, a ball control seat, a plurality of gate assemblies, and a plurality of blowers. The box body is a rectangular box with an open bottom. The box body has a plurality of accommodation spaces. A rear side of each accommodation space is provided with a ball inlet. A top of each accommodation space is connected with a tube. A ball tray is provided under each accommodation space. A central portion of the ball tray is formed with an air outlet. The air outlet is located under the tube. The ball guide seat includes a top plate and a seat body under the top plate. The top plate has a plurality of upper through holes and a plurality of ball return holes located behind the upper through holes, respectively. The upper through holes and the ball return holes are arranged in pairs to form a plurality of sets arranged side by side. The seat body includes a plurality of ball passages therein. Upper ends of the ball passages are connected to the upper through holes, respectively. Lower ends of the ball passages are connected to lower through holes provided at a bottom of the seat body, respectively. The seat body is disposed on top of the box body. The lower through holes each correspond in position to an upper opening of the tube to communicate with the tube. The ball control seat is disposed on the top plate of the ball guide seat. The ball control seat comprises an upper seat plate assembly, a lower seat plate, at least two upright plates, a plurality of receiving tubes, a plurality of displacement plates, and a plurality of ball tracks. The upper seat plate assembly has a plurality of ball outlets. Each ball outlet is provided with a crosspiece to partition its diameter. The lower seat plate is disposed under the upper seat plate assembly and is mounted on top of the top plate of the ball guide seat. The lower seat plate has a plurality of limit holes. The limit holes correspond in position to the upper through holes and the ball return holes which are arranged in pairs so that the upper through holes and the ball return holes simultaneously communicate with the limit holes, respectively. The upright plates are disposed between the upper seat plate assembly and the lower seat plate so that a space is formed between the upper seat plate assembly and the lower seat plate. The receiving tubes are disposed in the space. Lower ends of the receiving tubes are inserted in the limit holes, respectively. A rear side of each receiving tube is connected with a first telescopic cylinder. Each receiving tube has upper and lower openings and is driven by the first telescopic cylinder to move back and forth. When the receiving tubes are located at front ends of the limit holes, the receiving tubes communicate with the upper through holes and the ball outlets, respectively. When the receiving tubes are located at rear ends of the limit holes, the receiving tubes communicate with the ball return holes, respectively. The displacement plates each have a front hole at a front end thereof and a rear hole at a rear end thereof.

The rear end of each displacement plate is connected with a second telescopic cylinder. Each displacement plate is received in a bottom of the lower seat plate and is driven by the second telescopic cylinder to move back and forth. When the displacement plates are in a retraction state, the front holes of the displacement plates communicate with the upper through holes and the displacement plates close the ball return holes. When the displacement plates are in an advance state, the rear holes of the displacement plates communicate with the ball return holes and the displacement plates close the upper through holes. The ball tracks each have an upper opening and a lower opening. The upper opening is located under a corresponding one of the ball return holes of the top plate. The lower opening corresponds in position to the ball inlet. Each gate assembly is located between the ball inlet and the lower opening of a corresponding one of the ball tracks for opening or closing the ball inlet. Each blower is located under the air outlet of the ball tray.

In an embodiment, a bottom of each limit hole of the lower seat plate is provided with a track trough. Each displacement plate is received in the track trough of the lower seat plate.

In an embodiment, each gate assembly includes a reverse U-shaped gate frame. Two sides of the gate frame are recessed to form rails, respectively. A gate is insertedly disposed on the rails. A bottom of the gate has an L-shaped extension portion. A third telescopic cylinder is provided above the extension portion. The third telescopic cylinder is fixed to an edge of the gate frame so that the gate is driven by the third telescopic cylinder to move up and down. A front of the gate frame is mounted to an outer edge of the ball inlet. The lower opening of the corresponding ball track is mounted to a back of the gate frame. When the gate is moved downward to be opened, the ball inlet is in communication with the lower opening of the corresponding ball track. When the gate is moved upward to be closed, the ball inlet is not in communication with the lower opening of the corresponding ball track.

In an embodiment, the upper seat plate assembly is composed of a main plate and a secondary plate. The main plate has a plurality of upper ball outlets. The secondary plate has a plurality of lower ball outlets. The upper ball outlets are aligned with the lower ball outlets to form the ball outlets, respectively. An outer circumference of a bottom of each upper ball outlet is provided with an upper annular groove. An outer circumference of a top of each lower ball outlet is provided with a lower annular groove. An induction coil is provided and accommodated between the upper annular groove and the lower annular groove.

In an embodiment, a bottom of each receiving tube is provided with two notches which are longitudinally opposite to each other. Each displacement plate has a raised portion between the front hole and the rear hole. The raised portion can pass through the notches of the receiving tube.

In an embodiment, the first telescopic cylinder is connected to a first positioning seat. The first positioning seat is fixed under the upper seat plate assembly. The second telescopic cylinder is connected to a second positioning seat. The second positioning seat is fixed to the top plate of the ball guide seat.

In an embodiment, each receiving tube is provided with a sensing optical fiber inserted through an inside of the receiving tube.

In an embodiment, a stop rod is provided on the air outlet.

In an embodiment, the ball passages extend downwardly and radially. The ball passages are arranged obliquely and centered from two sides of the bottom of the seat body toward the top plate.

Through the above structure, the lottery ball machine can draw the respective balls from the accommodation spaces. The same machine may be used for different games at the same time to speed up the games. Players can easily see the drawn balls of all the games, thereby enhancing the interest of the players and increasing the economic benefits of the gaming machine and reducing the equipment cost.

DETAILED DESCRIPTION OF THE PREFERRED EMBODIMENT

Figure 1:
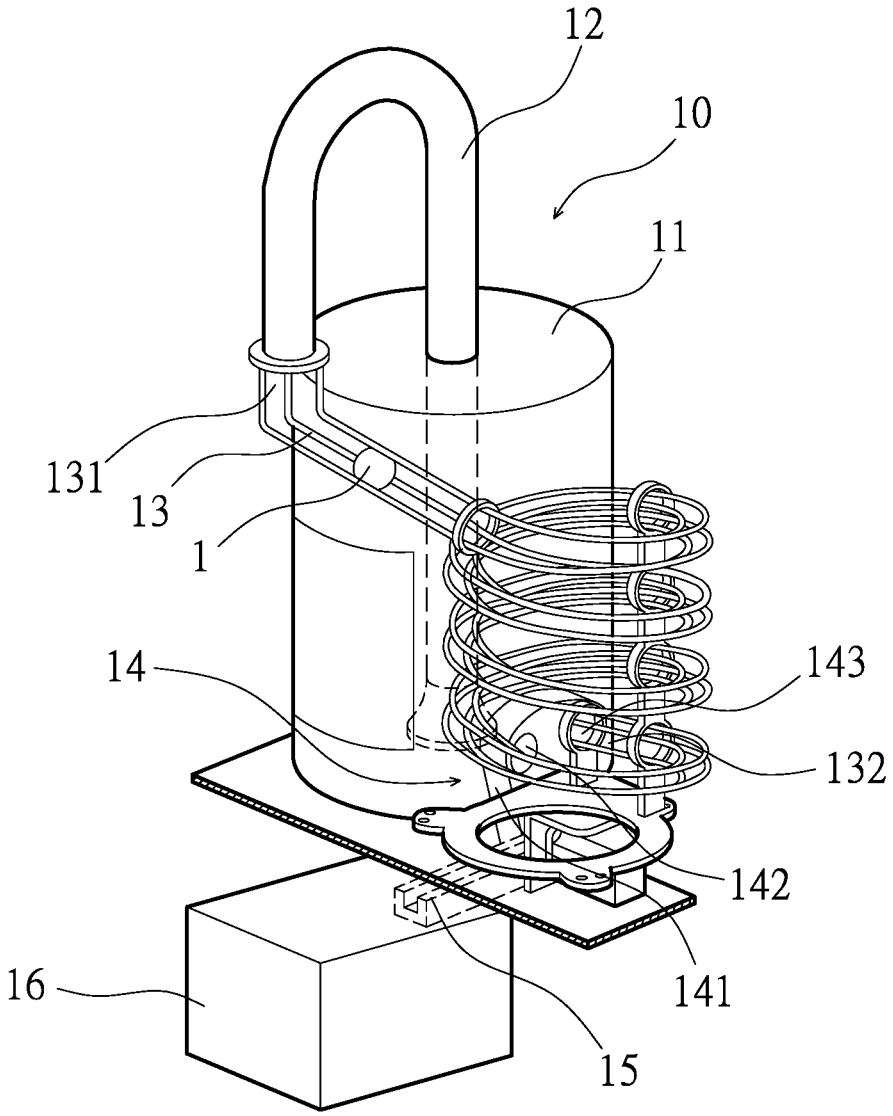
FIG.1 PRIOR ART
FIG. 1 is a perspective view of a conventional lottery ball machine.

Embodiments of the present invention will now be described, by way of example only, with reference to the accompanying drawings.

Referring to FIG. 2 to FIG. 16, a lottery ball machine comprises a box body 20, a ball guide seat 30, a ball control seat 40, a plurality of gate assemblies 50, and a plurality of blowers 60.

The box body 20 is a rectangular box with an open bottom. The box body 20 includes a plurality of identical partitions 21 therein so that the box body 20 is partitioned into a plurality of accommodation spaces 22. A rear side of each accommodation space 22 is provided with a ball inlet 23. A top of each accommodation space 22 is connected with a tube 24 for drawing a number ball. A ball tray 25 is provided under each accommodation space 22. A central portion of the ball tray 25 is formed with an air outlet 26. The air outlet 26 is located under the tube 24. A stop rod 27 is provided on the air outlet 26.

The ball guide seat 30 includes a top plate 31 and a seat body 32 under the top plate 31. The top plate 31 has a plurality of upper through holes 33 arranged in order and a plurality of ball return holes 34 located behind the upper through holes 33 and arranged in order. The upper through holes 33 and the ball return holes 34 are arranged in pairs to form a plurality of sets arranged side by side. The seat body 32 includes a plurality of ball passages 35 therein. The ball passages 35 extend downwardly and radially. That is, the ball passages 35 are arranged obliquely and centered from two sides of the bottom of the seat body 32 toward the top plate 31. Upper ends of the ball passages 35 are connected to the upper through holes 33, respectively. Lower ends of the ball passages 35 are connected to lower through holes 36 disposed at the bottom of the seat body 32, respectively. The seat body 32 is disposed on top of the box body 20. The lower through holes 36 each corresponds in position to an upper opening of the tube 24 to communicate with the tube 24.

The ball control seat 40 is disposed on the top plate 31 of the ball guide seat 30. The ball control seat 40 comprises an upper seat plate assembly 41, a lower seat plate 44, at least two upright plates 45, a plurality of receiving tubes 46, a plurality of displacement plates 47, and a plurality of ball tracks 48. The upper seat plate assembly 41 has a plurality of ball outlets 42 arranged in order. Each ball outlet 42 is provided with a crosspiece 43 to partition its diameter. The upper seat plate assembly 41 is composed of a main plate 411 and a secondary plate 412. The main plate 411 has a plurality of upper ball outlets 413 arranged in order. The secondary plate 412 has a plurality of lower ball outlets 414 arranged in order. The upper ball outlets 413 are aligned with the lower ball outlets 414 to form the ball outlets 42, respectively. An outer circumference of a bottom of each upper ball outlet 413 is provided with an upper annular groove 415. An outer circumference of a top of each lower ball outlet 414 is provided with a lower annular groove 416. An induction coil 417 is accommodated between the upper annular groove 415 and the lower annular groove 416. The lower seat plate 44 is disposed under the upper seat plate assembly 41 and is mounted on top of the top plate 31 of the ball guide seat 30. The lower seat plate 44 has a plurality of limit holes 441 arranged in order. The limit holes 441 correspond in position to the upper through holes 33 and the ball return holes 34 which are arranged in pairs so that the upper through holes 33 and the ball return holes 34 simultaneously communicate with the limit holes 441, respectively. A bottom of each limit hole 441 of the lower seat plate 44 is provided with a track trough 442. The upright plates 45 are disposed between the upper seat plate assembly 41 and the lower seat plate 44 so that a space 451 is formed between the upper seat plate assembly 41 and the lower seat plate 44. The receiving tubes 46 are disposed in the space 451. Lower ends of the receiving tubes 46 are inserted in the limit holes 441, respectively. A rear side of each receiving tube 46 is connected with a first telescopic cylinder 461. The first telescopic cylinder 461 is connected to a first positioning seat 462. The first positioning seat 462 is fixed under the upper seat plate assembly 41. Each receiving tube 46 has upper and lower openings and is driven by the first telescopic cylinder 461 to move back and forth. When the receiving tubes 46 are located at the front ends of the limit holes 441, the receiving tubes 46 communicate with the upper through holes 33 and the ball outlets 42, respectively. When the receiving tubes 46 are located at the rear ends of the limit holes 441, the receiving tubes 46 communicate with the ball return holes 34, respectively. Each receiving tube 46 is provided with a sensing optical fiber 463 inserted through the inside of the receiving tube 46. The bottom of each receiving tube 46 is provided with two notches 464 which are longitudinally opposite to each other. Each displacement plate 47 has a front hole 471 at a front end thereof, a rear hole 472 at a rear end thereof, and a raised portion 473 between the front hole 471 and the rear hole 472. The rear end of each displacement plate 47 is connected with a second telescopic cylinder 474. The second telescopic cylinder 474 is connected to a second positioning seat 475. The second positioning seat 475 is fixed to the top plate 31 of the ball guide seat 30. Each displacement plate 47 is received in the track trough 442 of the lower seat plate 44 and is driven by the second telescopic cylinder 474 to move back and forth. The raised portion 473 can pass through the notches 464 of the corresponding receiving tube 46, without being obstructed. When the displacement plates 47 are in a retraction state, the front holes 471 of the displacement plates 47 communicate with the upper through holes 33, and the displacement plates 47 close the ball return holes 34. When the displacement plates 47 are in an advance state, the rear holes 472 of the displacement plates 47 communicate with the ball return holes 34, and the displacement plates 47 close the upper through holes 33. Each ball track 48 has a circular upper opening 481 and a circular lower opening 482. The upper opening 481 is located under the corresponding ball return hole 34 of the top plate 31, and the lower opening 482 corresponds in position to the ball inlet 23.

Each gate assembly 50 is located between the ball inlet 23 and the lower opening 482 of the corresponding ball track 48. Each gate assembly 50 includes a reverse U-shaped gate frame 51. Two sides of the gate frame 51 are recessed to form rails 52, respectively. A gate 53 is insertedly disposed on the rails 52. The bottom of the gate 53 has an L-shaped extension portion 54. A third telescopic cylinder 55 is provided above the extension portion 54. The third telescopic cylinder 55 is fixed to the edge of the gate frame 51 so that the gate 53 is driven by the third telescopic cylinder 55 to move up and down. The front of the gate frame 51 is mounted to the outer edge of the ball inlet 23. The lower opening 482 of the corresponding ball track 48 is mounted to the back of the gate frame 51. When the gate 53 is moved downward to be opened, the ball inlet 23 is in communication with the lower opening 482. When the gate 53 is moved upward to be closed, the ball inlet 23 is not in communication with the lower opening 482.

Each blower 60 is located under the air outlet 26 of the ball tray 25.

Through the above structure, the lottery ball machine 200 can draw the respective balls 1 from the accommodation spaces 22. The same machine may be used for different games at the same time to speed up the games. Players can easily see the drawn balls of all the games, thereby enhancing the interest of the players and increasing the economic benefits of the gaming machine and reducing the equipment cost.

Figure 2:
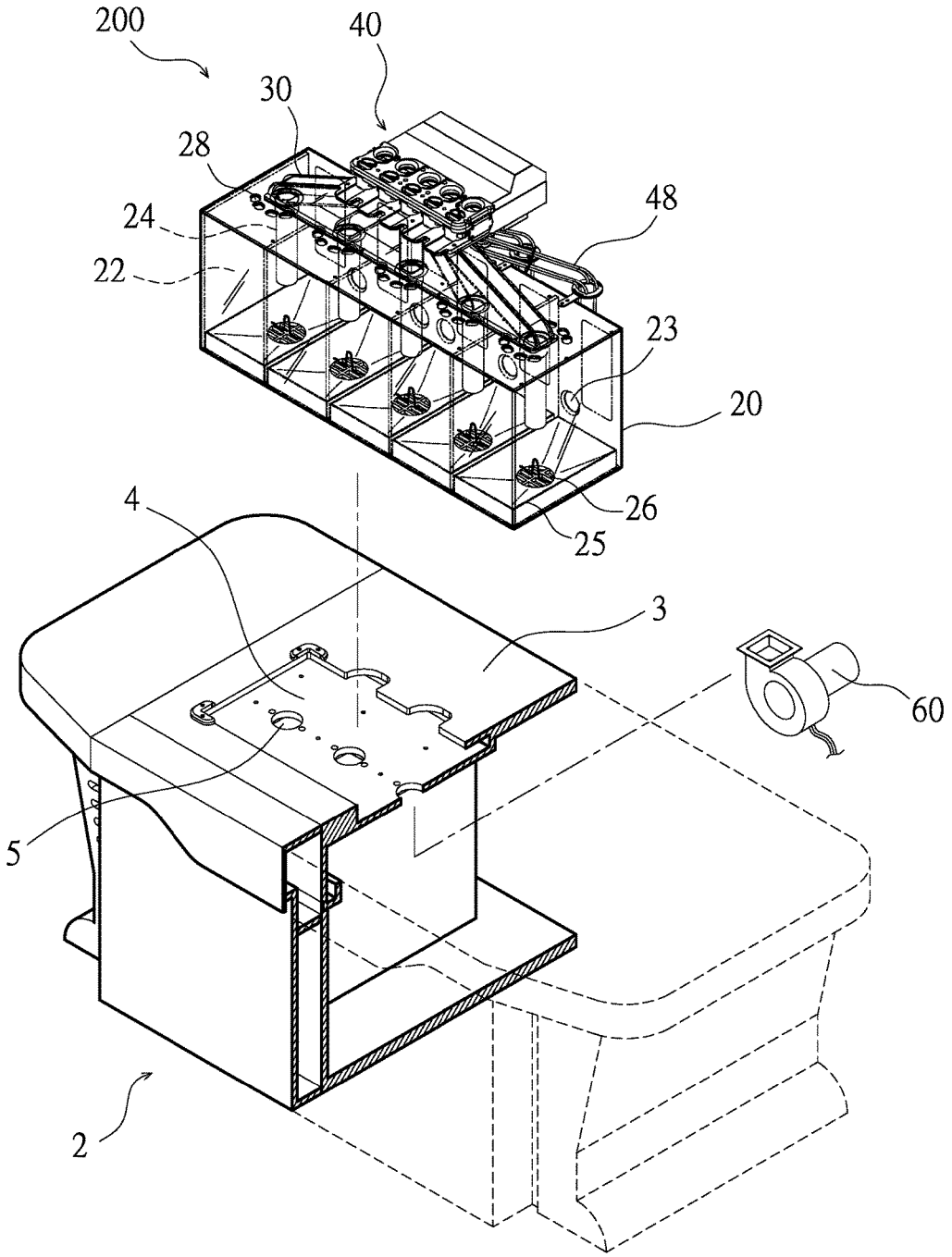
FIG. 2 is an exploded view of the present invention mounted to the machine stand.
Figure 3:
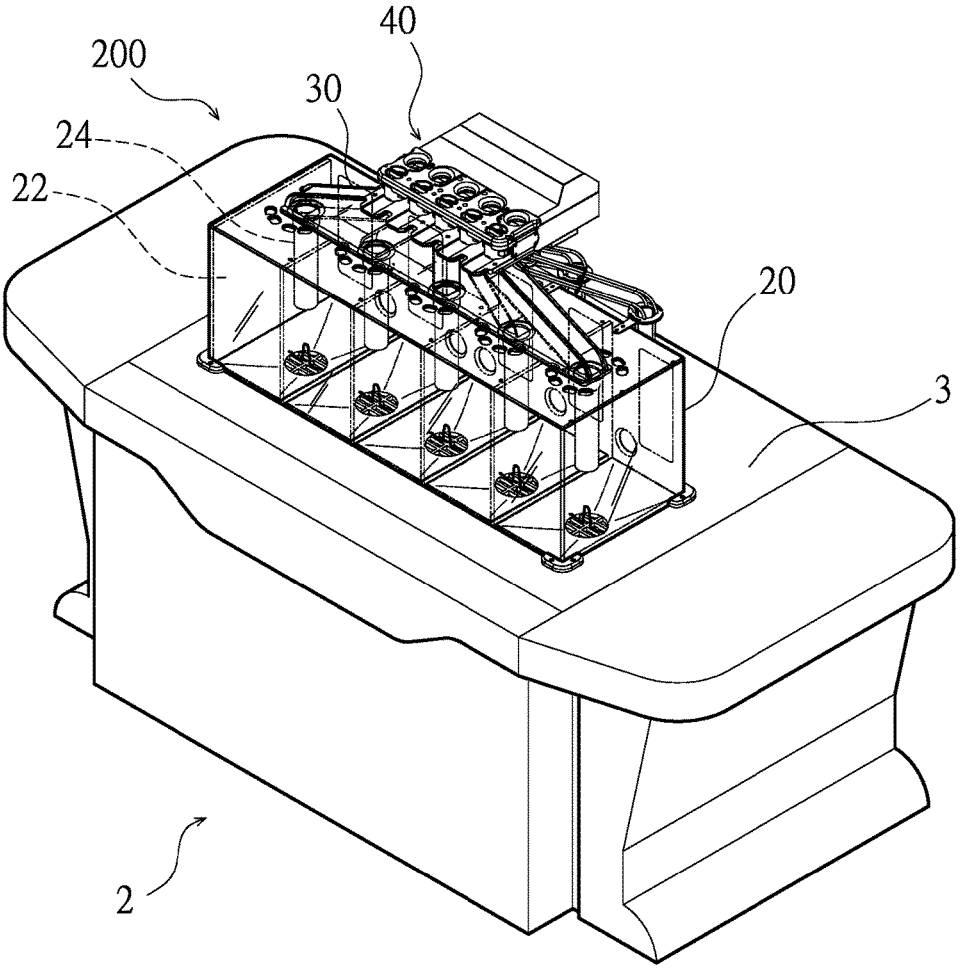
FIG. 3 is a perspective view of the present invention mounted to the machine stand.
Figure 4:
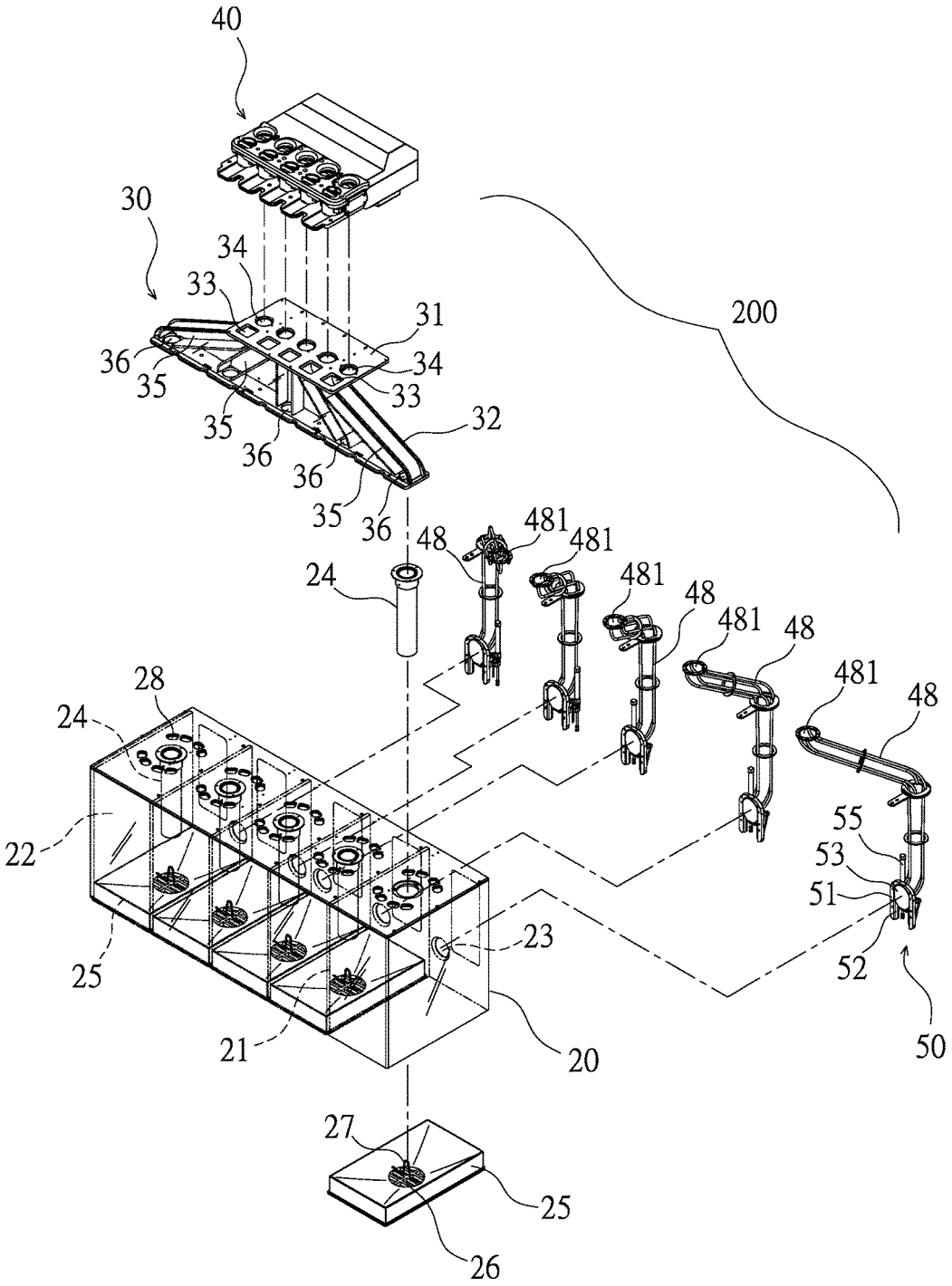
FIG. 4 is an exploded view of the lottery ball machine of the present invention.
Figure 5:
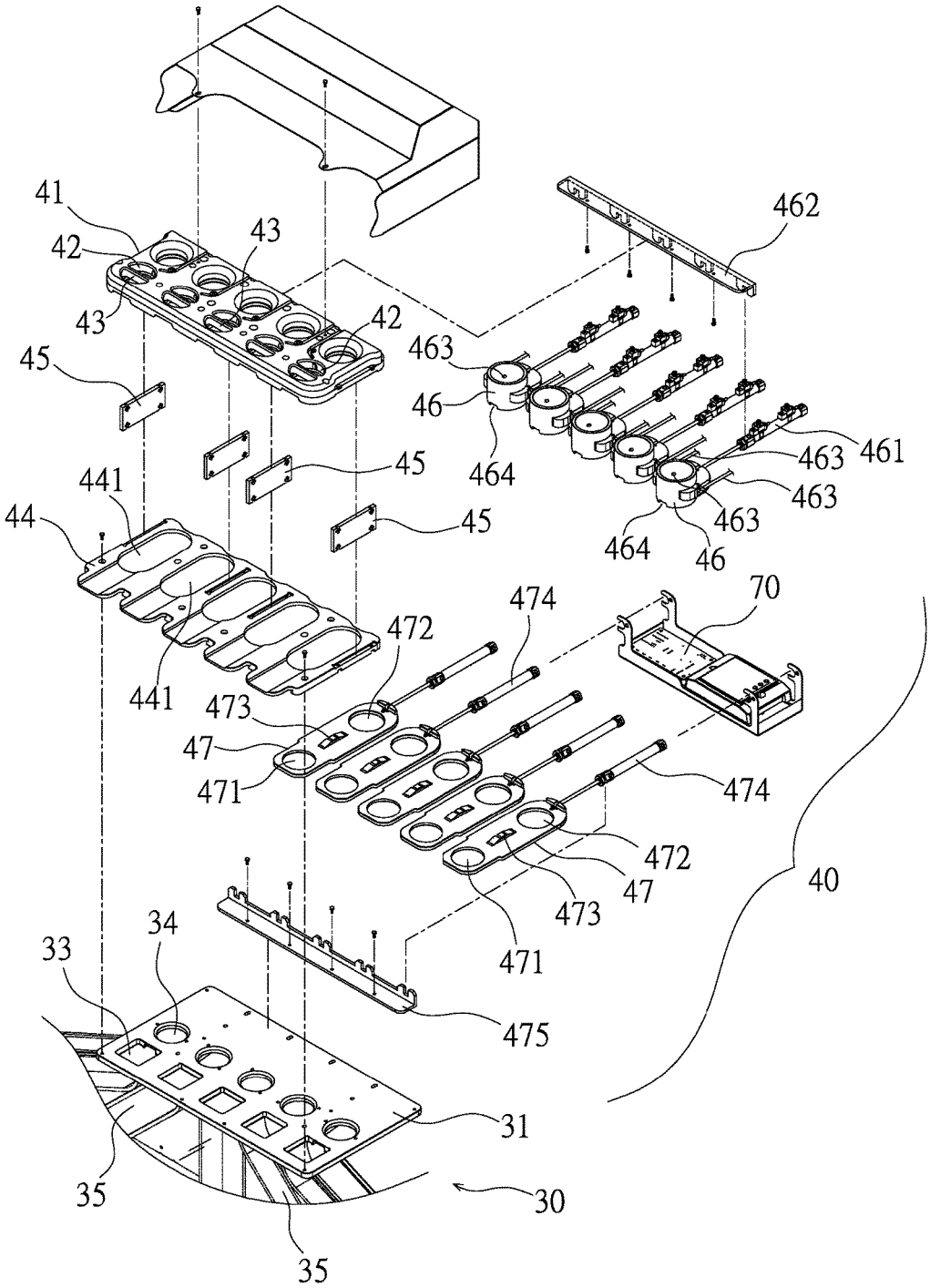
FIG. 5 is an exploded view of the ball control seat of the present invention.
Figure 6:
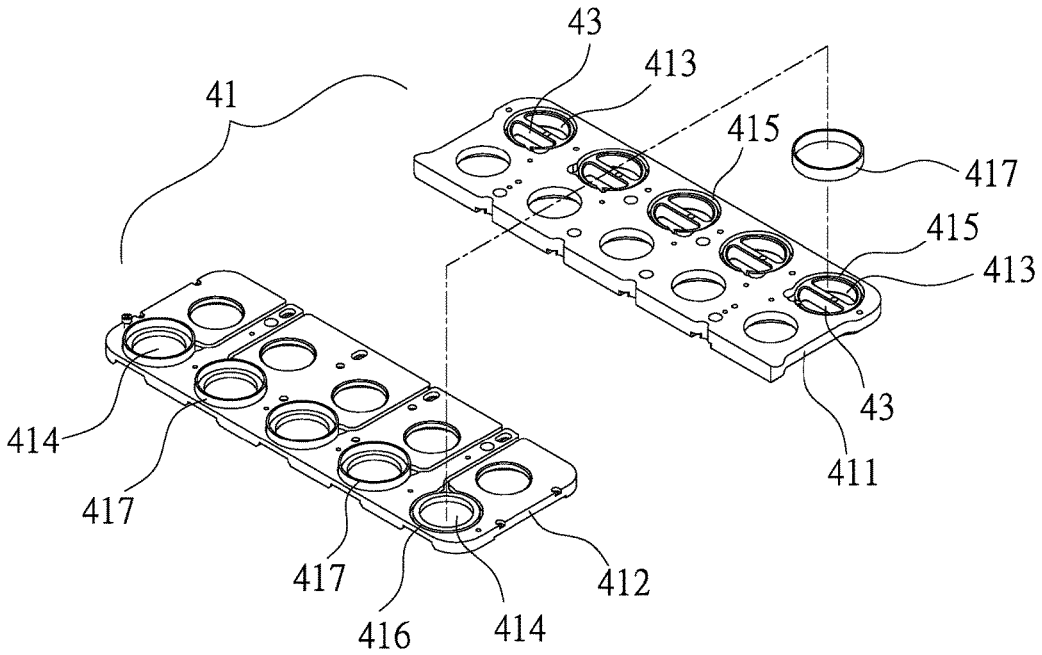
FIG. 6 is an exploded view of the upper seat plate assembly of the present invention.
Figure 7:
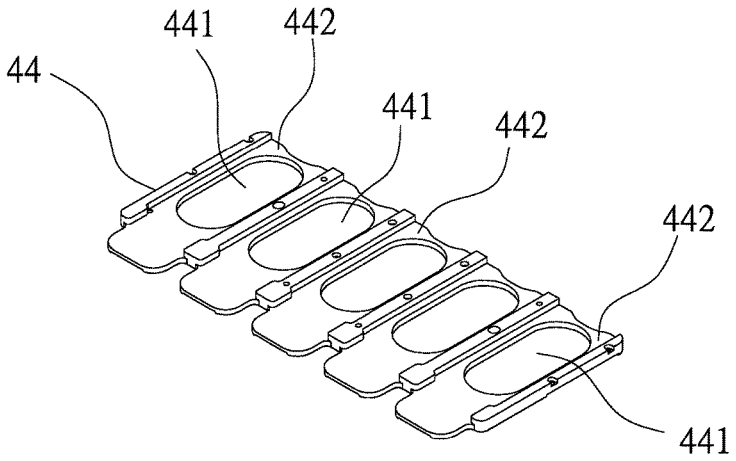
FIG. 7 is a bottom perspective view of the lower seat plate of the present invention.
Figure 8:
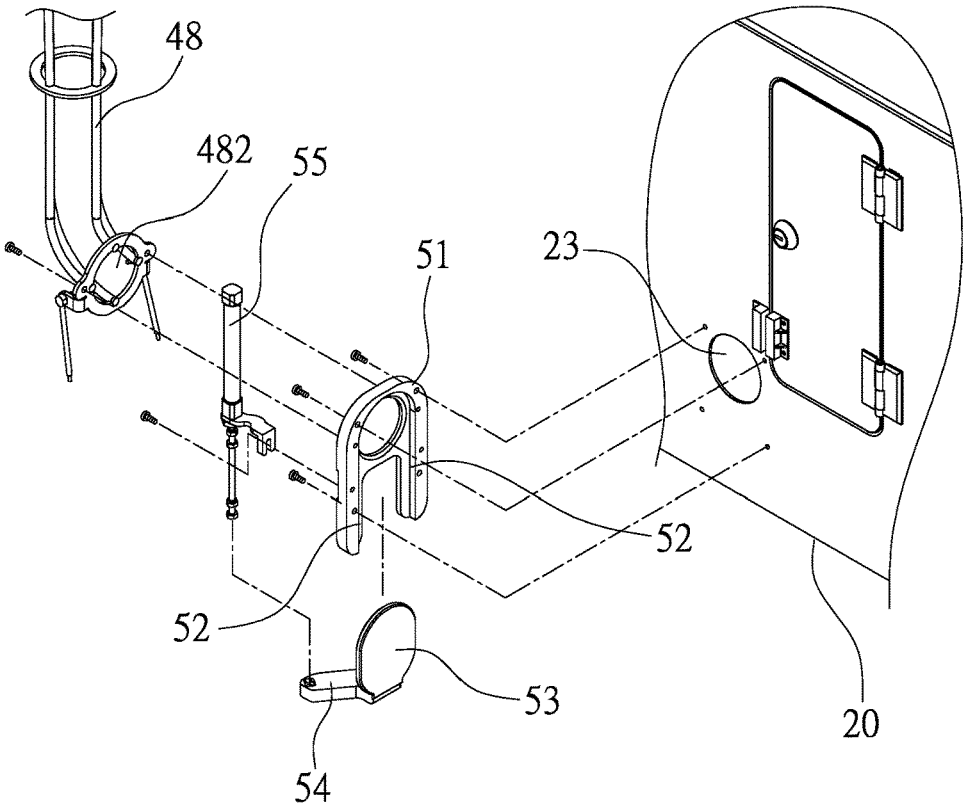
FIG. 8 is an exploded view of the gate assembly of the present invention.
Figure 9:
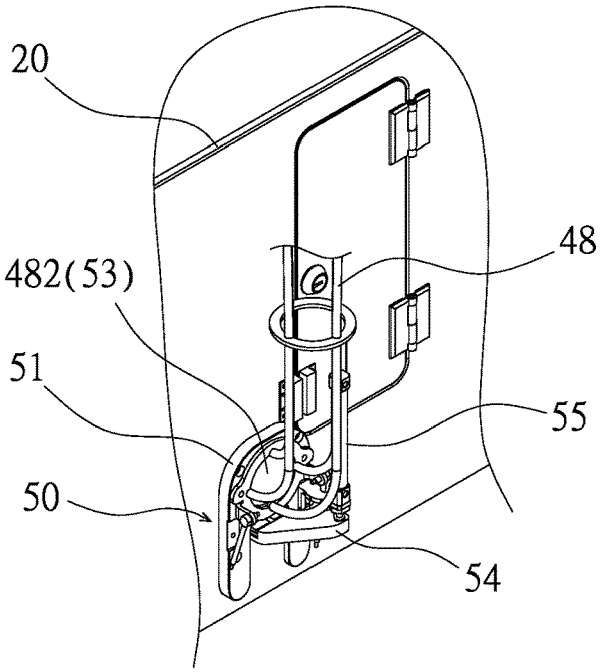
FIG. 9 is a perspective view of the gate assembly of the present invention.

The assembly, function and detail of the aforesaid embodiment are described hereinafter. As shown in FIG. 2 to FIG. 9, in an embodiment of the present invention, the lottery ball machine 200 may be disposed on a countertop 3 of a machine stand 2. The countertop 3 is recessed with a positioning trough 4 (as shown in FIG. 2) which is matched with the shape of the box body 20. The positioning trough 4 is provided with a plurality of vents 5 corresponding to the air outlets 26. The blowers 60 are mounted under the vents 5 of the countertop 3, respectively. The top of the accommodation space 22 of the box body 20 is provided with a plurality of convection holes 28. Therefore, the airflow generated by each blower 60 enters the accommodation space 22 through the vent 5 and the air outlet 26 of the ball tray 25, and the airflow entering the accommodation space 22 flows through the convection holes 28 to the outside, such that the airflow disturbs the balls 1 in the accommodation space 22 and one of the balls 1 can be drawn out through the tube 24 randomly. The shells of the box body 20 and ball guide seat 30 may be transparent, but not limited thereto, so that the player may watch the desired number or pattern of the ball 1 and track the path of the desired ball 1 through the transparent shells, thereby increasing the tension of the game and enhancing the player's pleasure. The lottery ball machine 200 is controlled by a computer game program. The lottery ball machine 200 may be provided with a circuit board 70 for controlling mechanical parts and sensing signals. The circuit board 70 transmits signals to the computer game program for computation and determination so as to control the operation of various parts.

Figure 10:
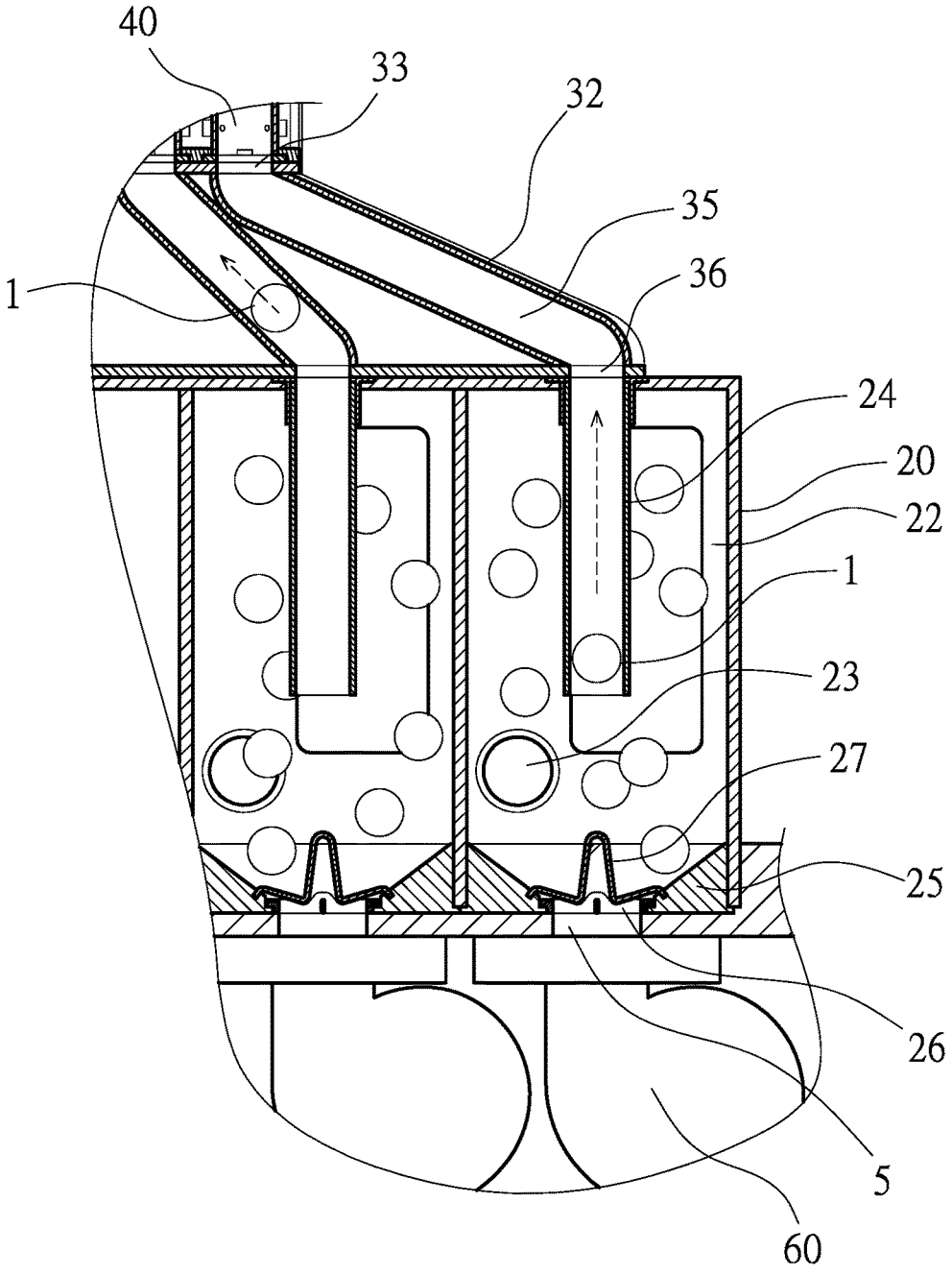
FIG. 10 is a sectional view of the present invention, showing that the balls in the accommodation spaces are disturbed to float.
Figure 11:
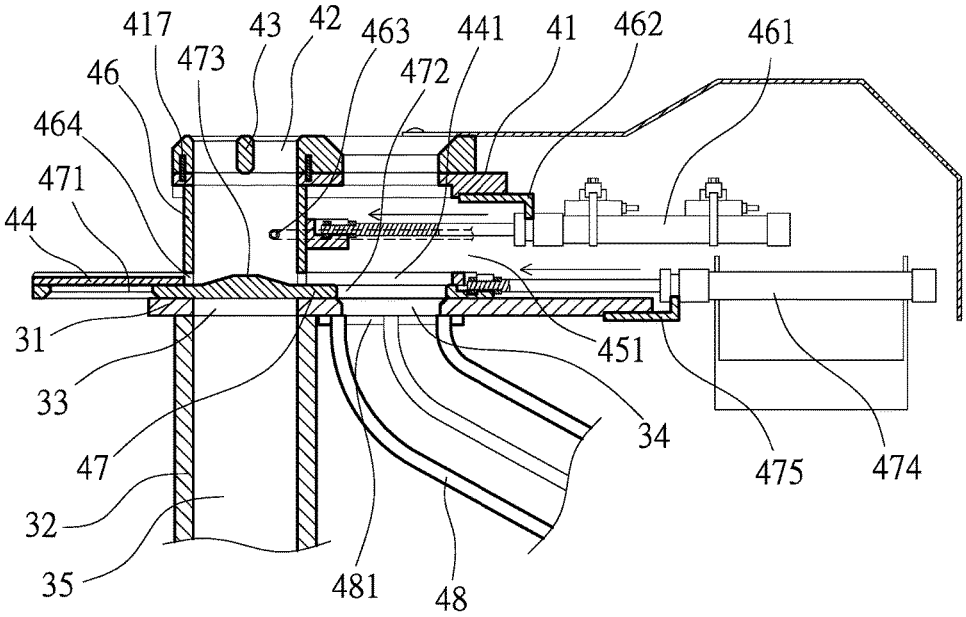
FIG. 11 is a sectional view of the ball control seat of the present invention, showing that the ball has not been drawn.
Figure 12:
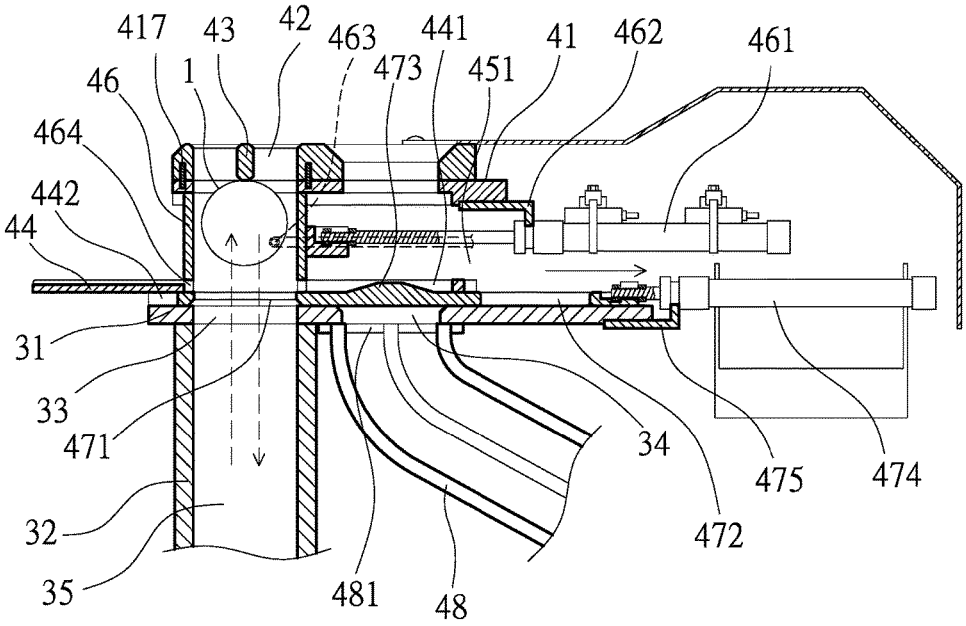
FIG. 12 is a sectional view of the ball control seat of the present invention, showing that the ball has been drawn.
Figure 13:
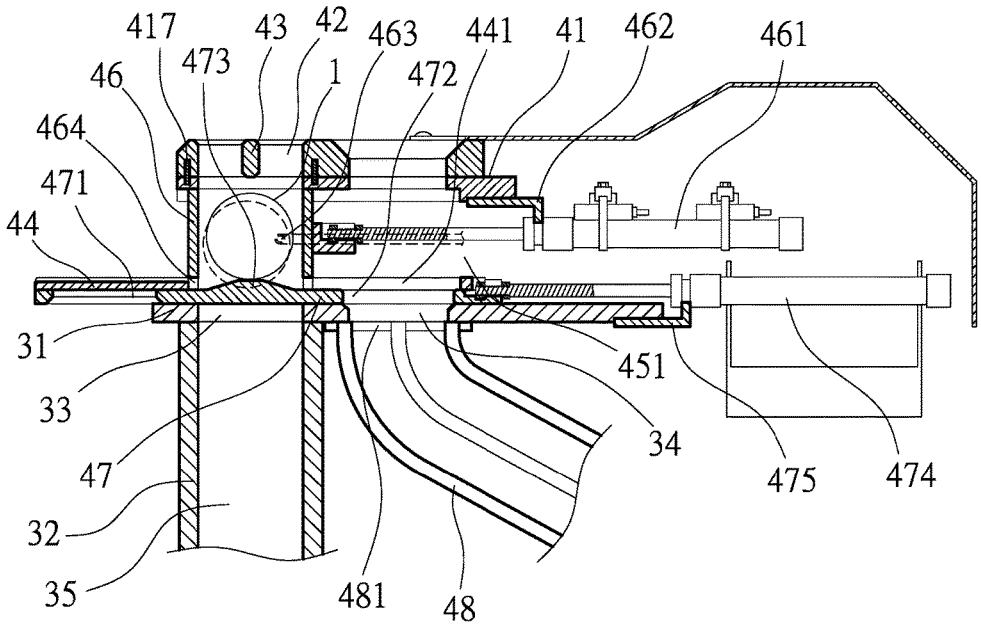
FIG. 13 is a sectional view of the ball control seat of the present invention, showing that the ball control seat changes the angle of the chip in the ball.
Figure 14:
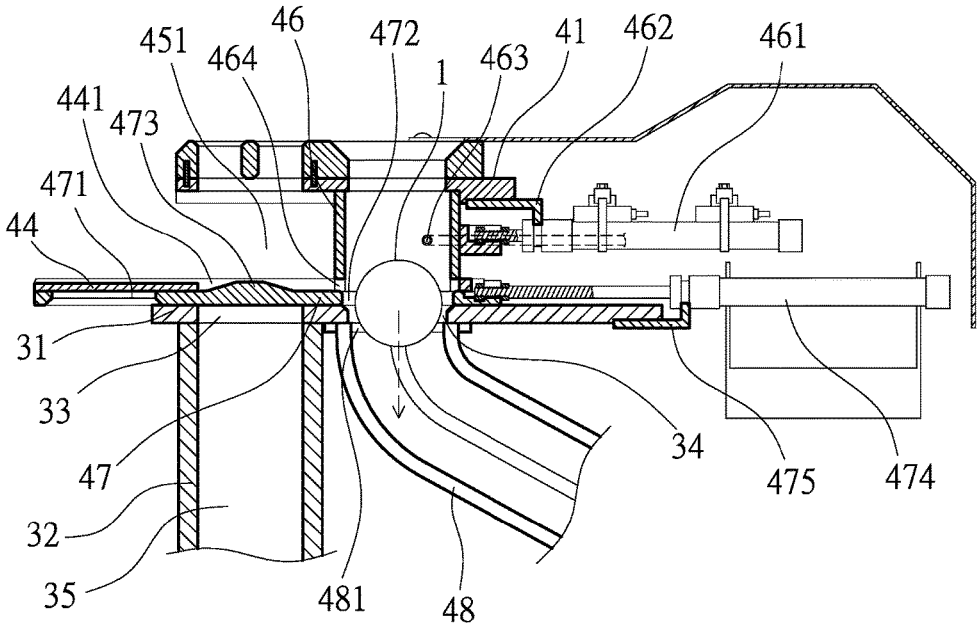
FIG. 14 is a sectional view of the ball control seat of the present invention, showing that the ball is recycled through the ball track.
Figure 15:
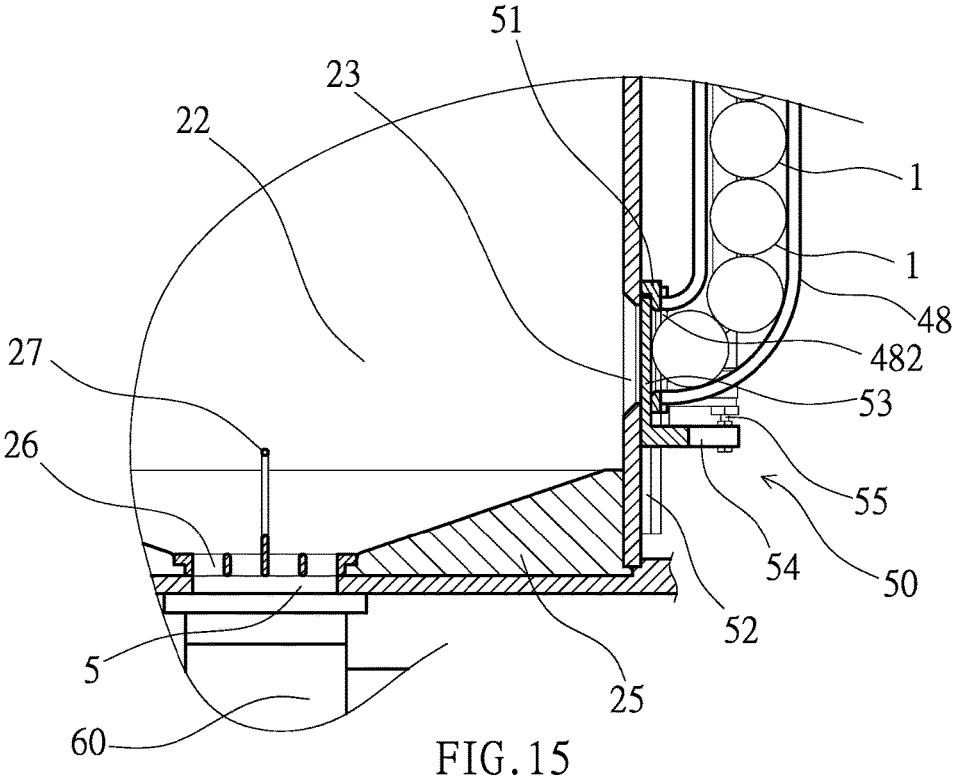
FIG. 15 is a sectional view of the present invention, showing that the gate assembly closes the ball inlet.
Figure 16:
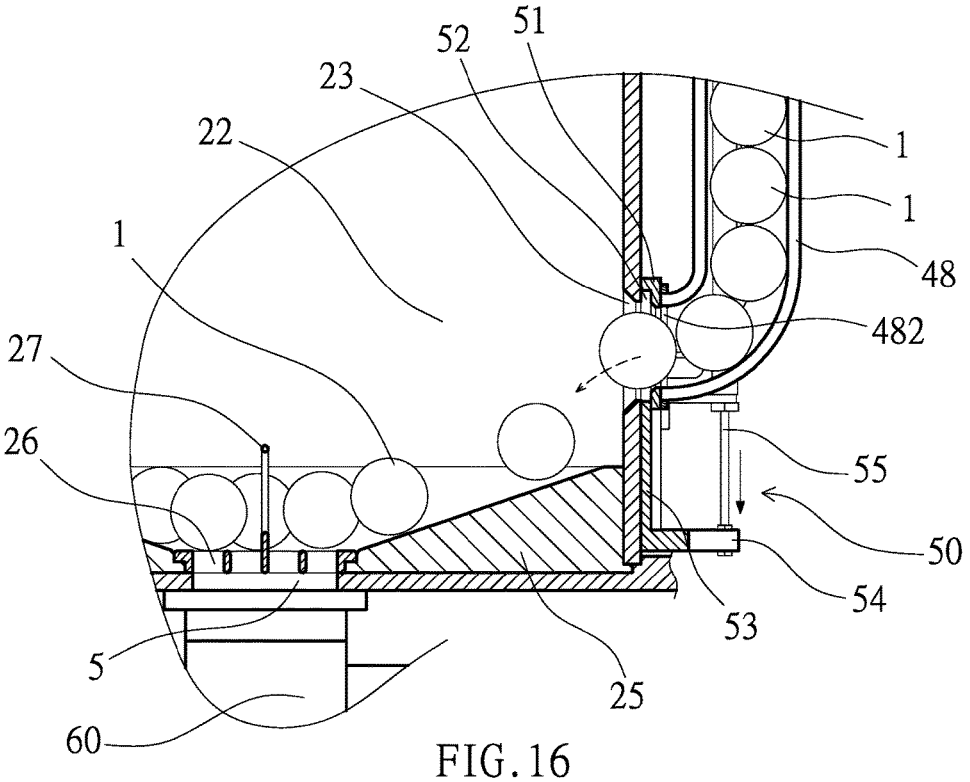
FIG. 16 is a sectional view of the present invention, showing that the gate assembly opens the ball inlet.

Referring to FIG. 2 to FIG. 15, when a game is to be played, the process of drawing a ball by one of the computer games is taken as an example. First, the first telescopic cylinder 461 is extended to move the receiving tube 46 to the front end of the limit hole 441 so that the upper through hole 33, the receiving tube 46 and the ball outlet 42 are located at the same axis, and the second telescopic cylinder 474 is extended to move the displacement plate 47 frontward for the raised portion 473 of the displacement plate 47 to pass through the notch 464 of the receiving tube 46 to enter the receiving tube 46 so that the upper through hole 33 and the receiving tube 46 are blocked and do not communicate with each other (as shown in FIG. 11). At this time, the blower 60 is activated and the airflow of the blower 60 is blown upwardly through the air outlet 26 of the ball tray 25 to generate an updraft in the accommodation space 22 for the balls 1 of the ball tray 25 to move up and down (as shown in FIG. 10). On the one hand, the airflow continuously enters the accommodation space 22 through the air outlet 26, and on the other hand the airflow is discharged by the convection holes 28 to form a convection circulation. After a period of disturbance, the second telescopic cylinder 474 is retracted to move the displacement plate 47 backwards. The raised portion 473 is withdrawn out of the receiving tube 46 from the notch 464 of the receiving tube 46, and the front hole 471 of the displacement plate 47 corresponds in position to the upper through hole 33 and the receiving tube 46 (as shown in FIG. 12), so that the upper through hole 33 communicates with the receiving tube 46. In this way, the tube 24 and the lower through hole 36, the ball passage 35, the upper through hole 33 and the receiving tube 46 are communicated with each other. The airflow of the blower 60 flows into the tube 24 and is discharged through the ball outlet 42 to form a convection circulation. The ball 1 can enter the tube 24 randomly. The ball passages 35 are centered from the two sides of the bottom toward the upper through holes 33 of the top plate 31, which facilitates the player's observation. In addition, the stop rod 27 is used to increase the stay time of the disturbed ball 1 at the air outlet 26, so that the ball 1 can enter the tube 24 easily, thereby shortening the time of drawing a ball. The ball 1 enters the receiving tube 46 from the tube 24 to pass through the lower through hole 36, the ball passage 35 and the upper through hole 33, and the fast moving ball 1 is blocked by the crosspiece 43 of the ball outlet 42. The induction coil 417 on the receiving tube 46 can read the chip in the ball 1 (the known technology of the chip interpretation will not be described herein), so that the ball 1 needed for the game can be drawn. The blower 60 continues to send the air flow so that the ball 1 can stay in the receiving tube 46 without falling. The sensing optical fiber 463 of the receiving tube 46 can sense the presence or absence of the ball 1, and can confirm the presence or absence of the ball 1, or detect whether the ball falls back to the accommodation space 22 or the ball track 48. When the sensing optical fiber 463 senses that the ball 1 enters the receiving tube 46 and the predetermined period of time (e.g., three seconds) elapses, the computer game program determines that the interpretation of the chip is delayed or poor. At this time, the second telescopic cylinder 474 is extended for the raised portion 473 to enter the bottom of the receiving tube 46 so that the ball 1 jumps to change the angle of the chip in the ball 1 (as shown in FIG. 13) so as to change the sensing angle of the chip in the ball 1. When the ball 1 is interpreted by the induction coil 417 and the number or pattern of the ball 1 is displayed in the computer game program, the computer game finishes drawing the ball 1 in stages and is waiting for display. There are two ways to recycle the ball. One is that the computer game program may stop the blower 60. If the angle of the chip in the ball 1 is corrected, the front hole 471 of the displacement plate 47 is moved to align with the upper through hole 33, and the ball 1 passes the original path of drawing the ball 1 and falls back to the accommodation space 22, and then a second ball 1 is drawn. This is used when the computer game needs to repeatedly draw the ball 1. When the computer game of this round is over and the computer game of next round is to be played, there is no need to wait for the time to recycle the ball 1. The other is that if the computer game does not require the ball 1 to be repeatedly drawn, the computer game finishes drawing the ball 1 in stages, the blower 60 does not need to be stopped, the third telescopic cylinder 55 is retracted so that the gate 53 closes the ball inlet 23, and the first telescopic cylinder 461 is retracted so that the receiving tube 46 corresponds to the position of the ball return hole 34, meanwhile, the second telescopic cylinder 474 moves the rear hole 472 of the displacement plate 47 to align with the ball return hole 34 (as shown in FIG. 14). The ball 1 in the receiving tube 46 passes through the ball return hole 34 to fall into the ball track 48, and the ball 1 is blocked by the gate 53 to be stored in the ball track 48 (as shown in FIG. 15), and then the second ball 1 is drawn. The rest may be drawn by analogy so that the balls are stacked one by one in the ball track 48. When the computer game of this round ends and the computer game of next round is to be played, the computer game program commands the third telescopic cylinder 55 to extend so that the gate 53 moves downwards to open the ball inlet 23, and the balls stacked in the ball track 48 pass through the ball inlet 23 to fall into the accommodation space 22 (as shown in FIG. 16) for the use of next round, thereby achieving automatic recycling. At the same time, other computer games may draw the ball 1. The same machine may be used for different games at the same time to speed up the games, thereby increasing the economic benefits of the gaming machine and reducing the equipment cost.

Please refer to FIG. 11 to FIG. 14, when the ball 1 in the receiving tube 46 falls from the upper through hole 33 to the accommodation space 22 or from the ball return hole 34 to the ball track 48, if the sensing optical fiber 463 senses that the ball 1 has not properly dropped and recycled to encounter an obstacle (for example, the ball 1 should not stay in the receiving tube 46, but it is sensed that the stay time is more than 3 seconds), the computer game program will pause the game and inform the person of this situation. After the obstacle is removed, the computer game continues to be played.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lottery ball machine, comprising a box body, a ball guide seat, a ball control seat, a plurality of gate assemblies, and a plurality of blowers;

the box body being a rectangular box with an open bottom, the box body having a plurality of accommodation spaces, a rear side of each accommodation space being provided with a ball inlet, a top of each accommodation space being connected with a tube, a ball tray being provided under each accommodation space, a central portion of the ball tray being formed with an air outlet, the air outlet being located under the tube;

the ball guide seat including a top plate and a seat body under the top plate, the top plate having a plurality of upper through holes and a plurality of ball return holes located behind the upper through holes respectively, the upper through holes and the ball return holes being arranged in pairs to form a plurality of sets arranged side by side, the seat body including a plurality of ball passages therein, upper ends of the ball passages being connected to the upper through holes respectively, lower ends of the ball passages being connected to lower through holes provided at a bottom of the seat body respectively, the seat body being disposed on top of the box body, the lower through holes each corresponding in position to an upper opening of the tube to communicate with the tube;

the ball control seat being disposed on the top plate of the ball guide seat, the ball control seat comprising an upper seat plate assembly, a lower seat plate, at least two upright plates, a plurality of receiving tubes, a plurality of displacement plates, and a plurality of ball tracks; the upper seat plate assembly having a plurality of ball outlets, each ball outlet being provided with a crosspiece to partition its diameter; the lower seat plate being disposed under the upper seat plate assembly and being mounted on top of the top plate of the ball guide seat, the lower seat plate having a plurality of limit holes, the limit holes correspond in position to the upper through holes and the ball return holes which are arranged in pairs so that the upper through holes and the ball return holes simultaneously communicate with the limit holes respectively; the upright plates being disposed between the upper seat plate assembly and the lower seat plate so that a space is formed between the upper seat plate assembly and the lower seat plate; the receiving tubes being disposed in the space, lower ends of the receiving tubes being inserted in the limit holes respectively, a rear side of each receiving tube being connected with a first telescopic cylinder, each receiving tube having upper and lower openings and being driven by the first telescopic cylinder to move back and forth, wherein when the receiving tubes are located at front ends of the limit holes, the receiving tubes communicate with the upper through holes and the ball outlets respectively, wherein when the receiving tubes are located at rear ends of the limit holes, the receiving tubes communicate with the ball return holes respectively; the displacement plates each having a front hole at a front end thereof and a rear hole at a rear end thereof, the rear end of each displacement plate being connected with a second telescopic cylinder, each displacement plate being received in a bottom of the lower seat plate and being driven by the second telescopic cylinder to move back and forth, wherein when the displacement plates are in a retraction state, the front holes of the displacement plates communicate with the upper through holes and the displacement plates close the ball return holes, wherein when the displacement plates are in an advance state, the rear holes of the displacement plates communicate with the ball return holes and the displacement plates close the upper through holes; the ball tracks each having an upper opening and a lower opening, the upper opening being located under a corresponding one of the ball return holes of the top plate, the lower opening corresponding in position to the ball inlet;

each gate assembly being located between the ball inlet and the lower opening of a corresponding one of the ball tracks for opening or closing the ball inlet;

each blower being located under the air outlet of the ball tray.

2. The lottery ball machine as claimed in claim 1, wherein a bottom of each limit hole of the lower seat plate is provided with a track trough, and each displacement plate is received in the track trough of the lower seat plate.

3. The lottery ball machine as claimed in claim 1, wherein each gate assembly includes a reverse U-shaped gate frame, two sides of the gate frame are recessed to form rails respectively, a gate is insertedly disposed on the rails, a bottom of the gate has an L-shaped extension portion, a third telescopic cylinder is provided above the extension portion, the third telescopic cylinder is fixed to an edge of the gate frame so that the gate is driven by the third telescopic cylinder to move up and down; a front of the gate frame is mounted to an outer edge of the ball inlet, the lower opening of the corresponding ball track is mounted to a back of the gate frame, when the gate is moved downward to be opened, the ball inlet is in communication with the lower opening of the corresponding ball track, when the gate is moved upward to be closed, the ball inlet is not in communication with the lower opening of the corresponding ball track.

4. The lottery ball machine as claimed in claim 1, wherein the upper seat plate assembly is composed of a main plate and a secondary plate, the main plate has a plurality of upper ball outlets, the secondary plate has a plurality of lower ball outlets, the upper ball outlets are aligned with the lower ball outlets to form the ball outlets respectively; an outer circumference of a bottom of each upper ball outlet is provided with an upper annular groove, an outer circumference of a top of each lower ball outlet is provided with a lower annular groove, and an induction coil is provided and accommodated between the upper annular groove and the lower annular groove.

5. The lottery ball machine as claimed in claim 1, wherein a bottom of each receiving tube is provided with two notches which are longitudinally opposite to each other, each displacement plate has a raised portion between the front hole and the rear hole, and the raised portion can pass through the notches of the receiving tube.

6. The lottery ball machine as claimed in claim 1, wherein the first telescopic cylinder is connected to a first positioning seat, the first positioning seat is fixed under the upper seat plate assembly, the second telescopic cylinder is connected to a second positioning seat, and the second positioning seat is fixed to the top plate of the ball guide seat.

7. The lottery ball machine as claimed in claim 1, wherein each receiving tube is provided with a sensing optical fiber inserted through an inside of the receiving tube.

8. The lottery ball machine as claimed in claim 1, wherein a stop rod is provided on the air outlet.

9. The lottery ball machine as claimed in claim 1, wherein the ball passages extend downwardly and radially, and the ball passages are arranged obliquely and centered from two sides of the bottom of the seat body toward the top plate.

* * * * *